United States Patent [19]

Walls et al.

[11] 4,385,477

[45] May 31, 1983

[54] LOOSE-FILL INSULATION METHOD AND APPARATUS

[76] Inventors: Earl M. Walls, Rt. #3, Box 396-C, Independence, Mo. 64050; E. G. Beckman, Jr., P.O. Drawer 68, Johnsonville, S.C. 29555

[21] Appl. No.: 314,127

[22] Filed: Oct. 23, 1981

[51] Int. Cl.[3] ..... E04B 1/74; E04C 2/52

[52] U.S. Cl. ..... 52/743; 52/220; 52/404

[58] Field of Search ..... 52/743, 220, 404–407, 52/221, 514

[56] References Cited

U.S. PATENT DOCUMENTS

| | | | |
|---|---|---|---|
| 2,788,552 | 4/1957 | Miles | 52/743 X |
| 4,068,434 | 1/1978 | Day et al. | 52/220 |
| 4,125,982 | 11/1978 | Ward | 52/743 X |
| 4,134,242 | 1/1979 | Musz et al. | 52/309.1 |
| 4,177,618 | 12/1979 | Felter | 52/743 |
| 4,328,652 | 5/1982 | Naumovich | 52/743 X |

FOREIGN PATENT DOCUMENTS

| | | | |
|---|---|---|---|
| 197805 | 5/1978 | United Kingdom | 52/743 |

*Primary Examiner*—J. Karl Bell

*Attorney, Agent, or Firm*—Larry Harold Kline

[57] ABSTRACT

A method and apparatus is disclosed for placing loose-fill insulation in a structural component containing structure cavities prior to the placement of the interior finish onto the structural component; the method comprising covering the structural component with a retainer barrier layer, opening a plurality of small entrances in the retainer barrier layer, and placing the loose-fill insulation through the plurality of small entrances in the structure cavities.

16 Claims, 10 Drawing Figures

LOOSE-FILL INSULATION METHOD AND APPARATUS

This invention relates to a method and apparatus for insulating cavities of structures and more particularly to a method and apparatus for insulating utilizing loose-fill insulation.

Presently, in new construction, loose-fill insulation is not utilized because the application of loose-fill insulation requires an opening in either the interior or exterior surface of a primarily finished wall through which the loose-fill insulation is placed. The finished walls act as a retainer for the loose-fill insulation which fills the cavities in the walls. For new construction, insulation of the blanket-type variety is primarily used for it can be secured into an unfinished wall prior to the placement of the building's interior finish. Application of the blanket-type insulation requires no openings in the exterior or interior surface of the wall. The present invention produces a method and apparatus for utilizing loose-fill insulation in new construction without disturbing the normal building process.

An object of the present invention is to provide a method and apparatus for placing loose-fill insulation into wall cavities prior to the placement of the building's interior finish on the walls.

Another object of the present invention is to provide a method and apparatus for applying loose-fill insulation into the cavities of walls in new construction without disturbing the normal building process.

A further object of the present invention is to utilize a retainer barrier layer which is secured across an interior wall prior to the placement of the building's interior finish for the purpose of placing loose-fill insulation through the retainer barrier layer and retaining the loose-fill insulation rigidly inside the retainer barrier layer.

Still another object of the present invention is to provide a method and apparatus for utilizing a retainer barrier as a vapor barrier and as a rigid retainer for holding loose-fill insulation in a wall cavity.

A further object of the present invention is to provide a retainer barrier layer which is rigid and will not bulge out from the wall when filled with loose-fill insulation.

Another object of the present invention is to provide a retainer barrier layer which functions as a retainer for loose-fill insulation in a wall cavity and is clear so that the amount of insulation within the wall cavity can be observed by the insulator.

Still another object of the present invention is to provide a new, easy method to insulate wall cavities in new construction utilizing loose-fill insulation.

These and other objects and features of the invention will be apparent from the following description and appended claims.

Briefly, the invention is a method and apparatus for placing loose-fill insulation in a structural component containing structure cavities prior to the placement of the interior finish onto the structural component. The method comprises covering the structural component with a retainer barrier layer, opening a plurality of small entrances in the retainer barrier layer, and placing the loose-fill insulation through the plurality of small entrances into the structure cavities. Each of the plurality of small entrances opens into one of the structure cavities. The plurality of small entrances is of sufficient number so that each of the structure cavities has at least one of the plurality of small entrances.

The retainer barrier layer may comprise shrink film. The shrink film may be heated by use of heating means prior to placing the loose-fill insulation through the plurality of small entrances into the structure cavities. The heating of the shrink film by use of heating means may also be done prior to opening the plurality of small entrances of the retainer barrier layer covering the structure cavities.

Electrical components may be placed in the structure cavities prior to covering the structure cavities with the retainer barrier layer. Plumbing components may be placed in the structure cavities prior to covering the structure cavities with the retainer barrier layer.

The retainer barrier layer may be secured around window and door units in the structural component. The retainer barrier layer covering the window and door units may be removed.

The plurality of small entrances in the retainer barrier layer may be patched after the loose-fill insulation is placed through the plurality of small entrances into the structure cavities. The retainer barrier layer may be reinforced to maintain better rigidity and strength in the material being utilized for the retainer barrier layer.

The retainer barrier layer may be secured to the structural component after the structural component has been covered with the retainer barrier layer. The retainer barrier layer may be secured around interior connections of electrical components. The retainer barrier layer covering the interior connections of electrical components may be removed. The retainer barrier layer may be secured around the interior connections of plumbing components. The retainer barrier layer covering the interior connections of plumbing components may be removed.

Window and door units may be placed into the structural component prior to covering the structural component with the retainer barrier layer.

The apparatus for placing loose-fill insulation in a structural component containing structure cavities prior to the placement of the interior finish onto the structural component comprises a retainer barrier layer secured over the structural component. A plurality of small entrances may be opened in the retainer barrier layer. Filling means is operative to be placed within each of the plurality of small entrances. The filling means fills the structure cavities with the loose-fill insulation. The shrink film may be a clear film which is operative for retention of the loose-fill insulation in the structure cavities and as a vapor barrier to aid in the insulating function of the apparatus, as well as being an aid to the user of the apparatus in seeing within the plurality of structure cavities.

The method and apparatus of the present invention discloses a way to install loose-fill insulation or blown insulation into a wall cavity or structure cavity in a structural component without disturbing the normal building process. All of the windows, doors, and electrical and plumbing components may be installed prior to the insulation. The loose-fill insulation may be installed prior to the placement of the interior finish of the structural component. The present invention utilizes a retainer barrier layer, such as shrink film. The characteristics of the retainer barrier layer will hold the loose-fill insulation in place without any serious leaking through the plurality of small entrances or openings in the retainer barrier layer.

The invention will be more fully understood from the following detailed description and appended claims when taken with the drawings in which:

FIG. 1 is a partial plane view of a wall being constructed using an old method of insulation.

FIG. 2 is a sectional view taken at section 2—2 of FIG. 1 with building exterior finish 5 and building interior finish 8 shown secured onto the wall.

Figure 4:
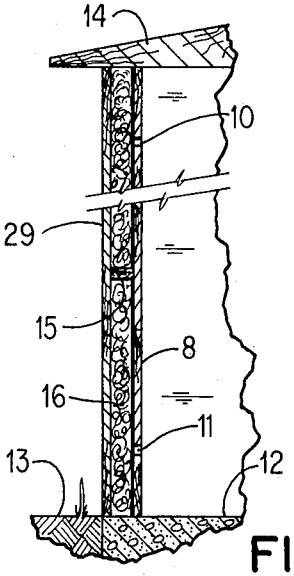

FIG. 4 is a partial sectional side view of a wall illustrating an old method of placing loose-fill insulation 16 into a wall by use of interior openings 10 and 11.

Figure 5:
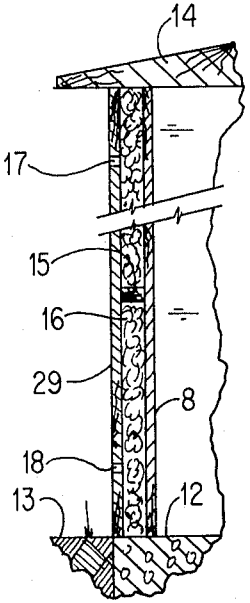

FIG. 5 is a partial sectional side view of a wall illustrating an old method of placing loose-fill insulation 16 into a wall by use of exterior openings 17 and 18.

Figure 6:
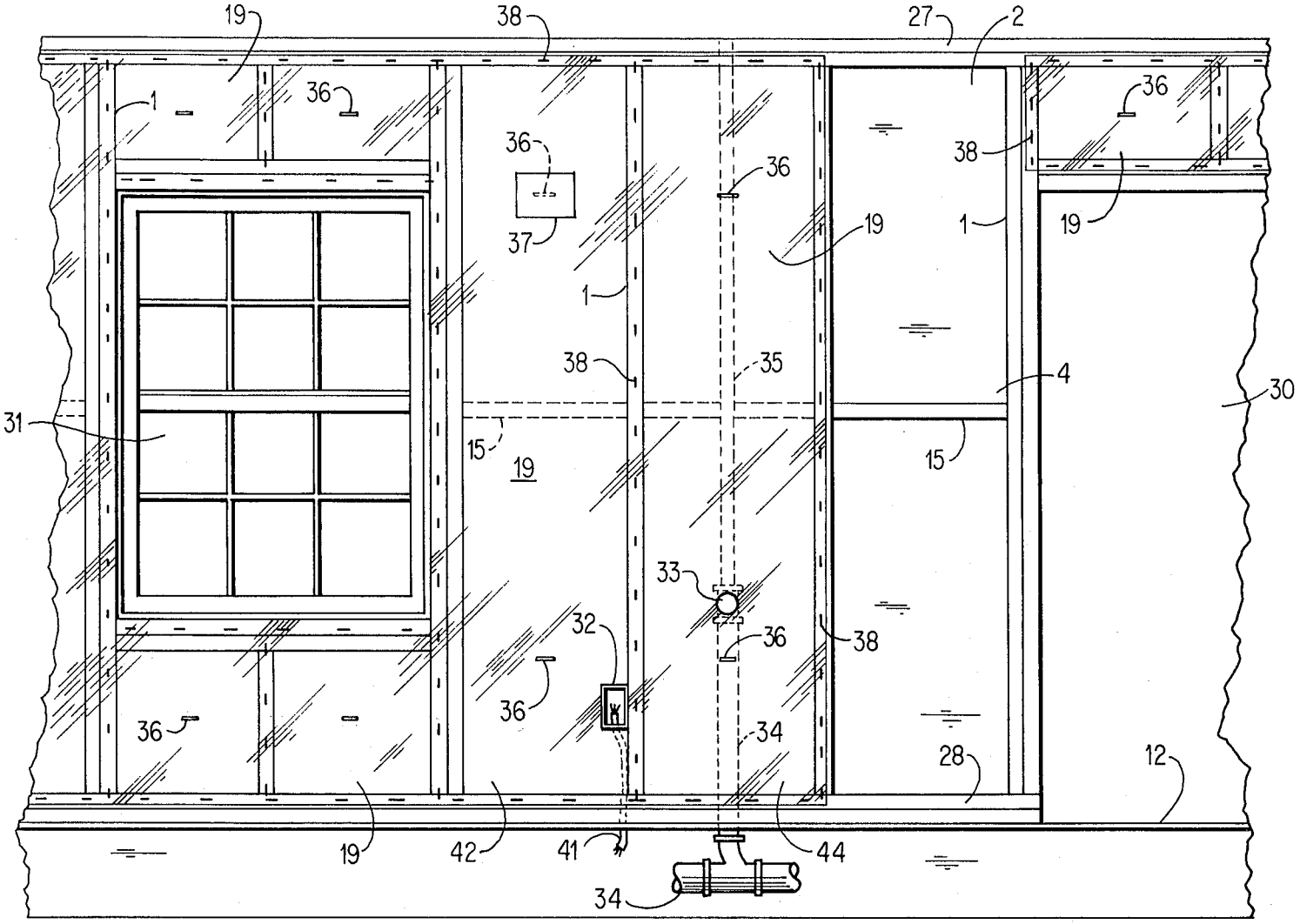

FIG. 6 is a partial plane view of a wall under construction illustrating a new method of placing loose-fill insulation 16 in the wall.

Figure 7:
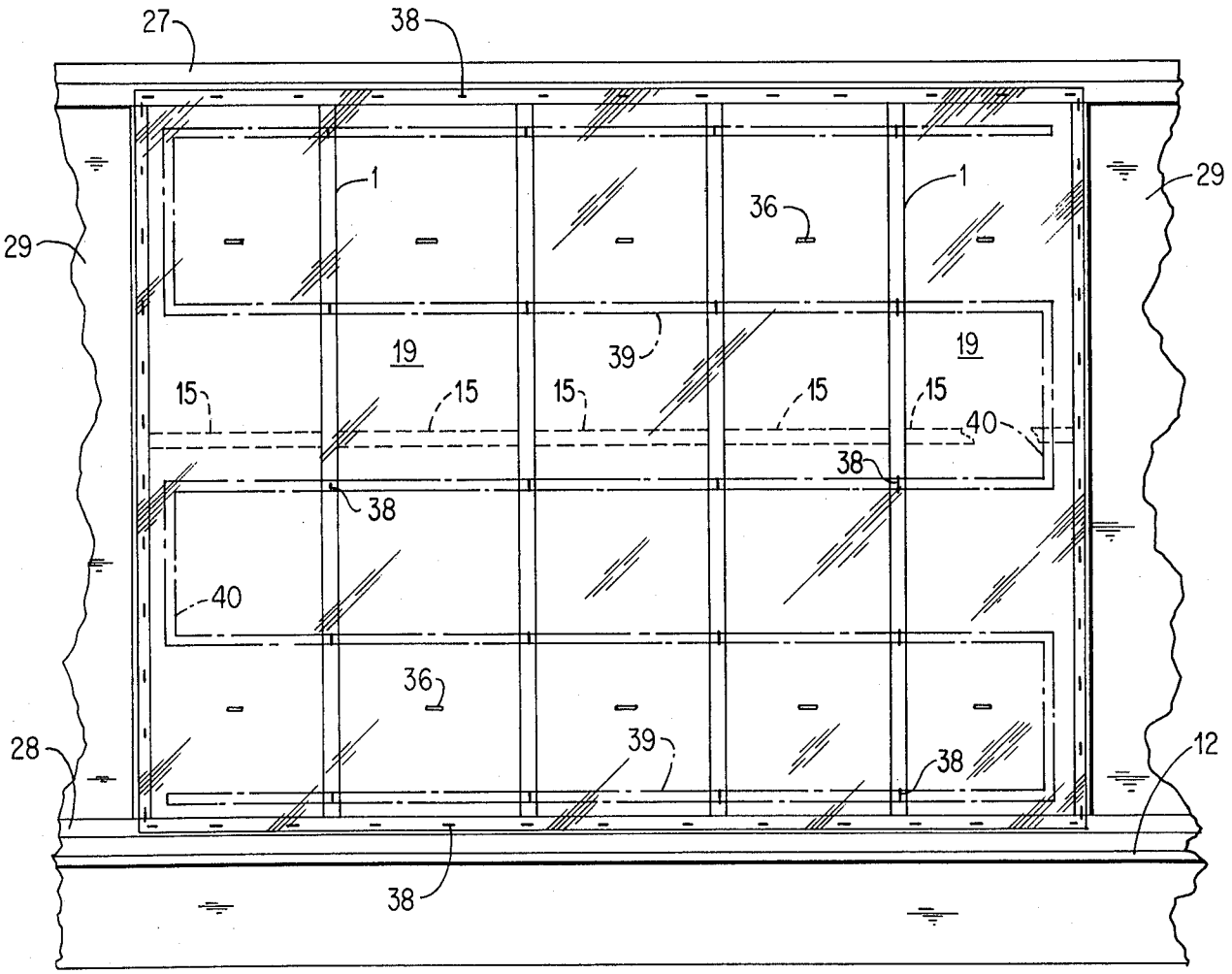

FIG. 7 is a partial plane view of a wall under construction illustrating an alternative new method of placing loose-fill insulation 16 in the wall.

Figure 8:
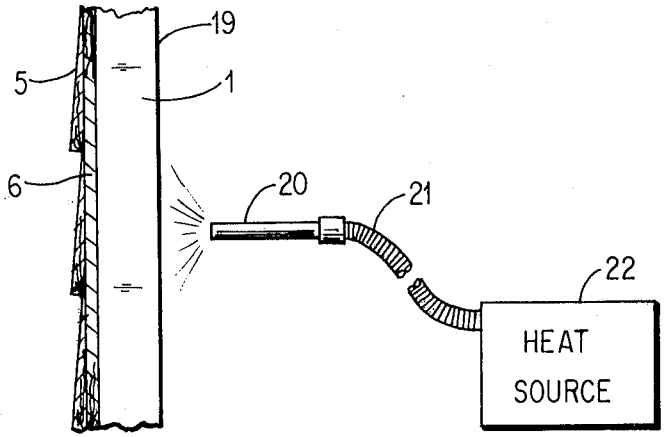

FIG. 8 is a partial sectional view of a wall illustrating how heat is applied to the retainer barrier layer 19 prior to the time that loose-fill insulation 16 is placed through the retainer barrier layer 19.

Figure 9:
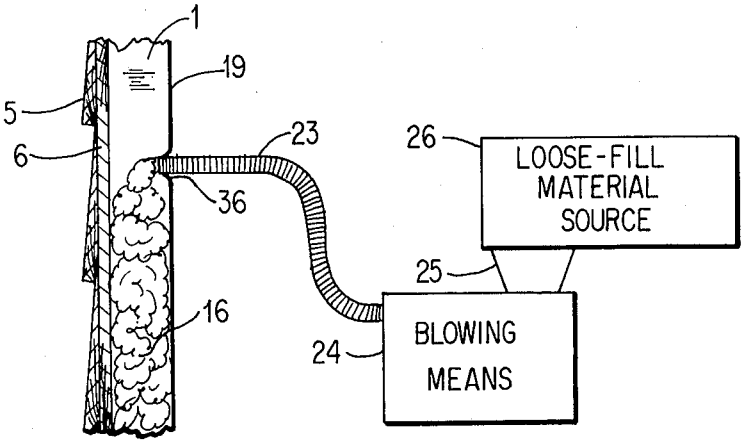

FIG. 9 is a partial sectional view of a wall illustrating how loose-fill insulation 16 is placed through retainer barrier layer 19.

Figure 1:
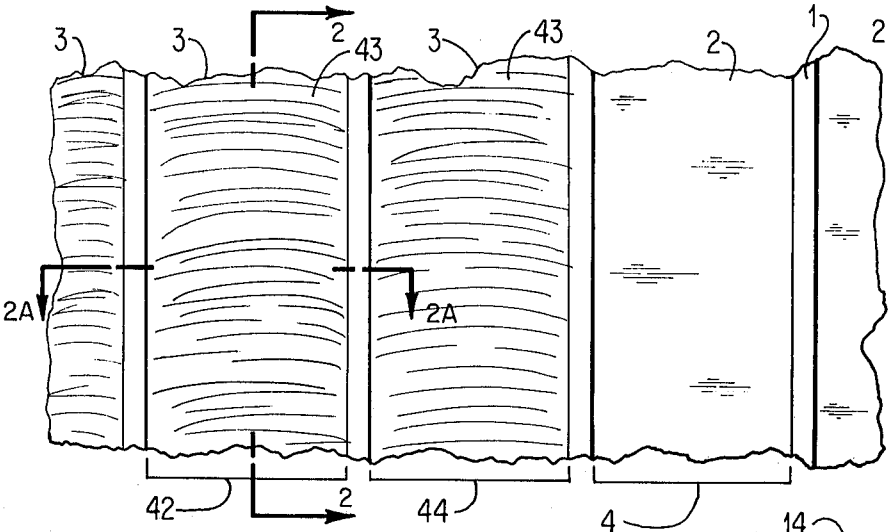

Referring now to the drawings, FIG. 1 is a partial plane view of a wall being constructed using an old method of insulation. The wall comprises a plurality of wall studs 1. Secured to the plurality of wall studs 1 is a wall sheathing 6 with an inner face 2. The plurality of wall studs 1 form a plurality of wall cavities. Wall cavity 4 has no insulation placed therein. Wall cavity 42 has the standard blanket-type insulation 3 with vapor barrier backing 43 secured thereon.

Figure 2:
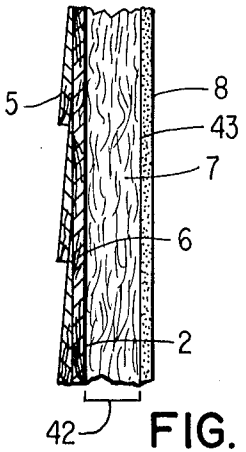
FIG. 2A is a sectional view taken at section 2A—2A of FIG. 1.

FIG. 2 is a sectional view taken at section 2—2 of FIG. 1 with building exterior finish 5 and building interior finish 8 shown secured onto the wall. Building exterior finish 5 is secured onto wall sheathing 6. Blanket-type insulation 3 is secured within the wall cavity 42. Blanket-type insulation 3 is pressed against the inner face 2 of wall sheathing 6. The building interior finish 8 is pressed against the vapor barrier backing 43 of blanket-type insulation 3. This standard construction utilizing blanket-type insulation 3 is in common use. The present invention enables loose-fill insulation 16 to be utilized in the wall cavities of new construction rather than the blanket-type insulation 3.

Figure 2A:
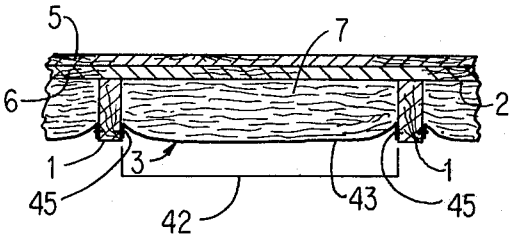

FIG. 2A is a sectional view taken at section 2A—2A of FIG. 1. The blanket-type insulation 3 is secured onto the inside of each of the plurality of wall studs 1 by securing means 45. Securing means 45 may be tacks, staples, nails, or any desired securing means.

Figure 3:
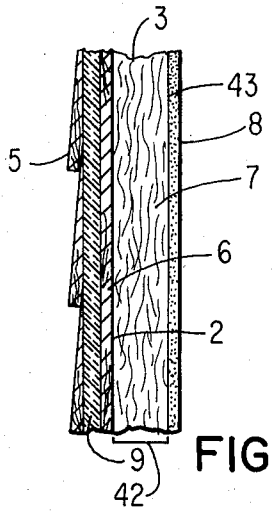
FIG. 3 is a partial sectional side view of a wall section using an old method of insulation including insulated board 9 under the building exterior finish 5.

FIG. 3 is a partial sectional side view of a wall section using an old method of insulation including insulation board 9 under the building exterior finish 5. The building exterior finish 5 is secured onto the insulation board 9 which is placed onto the wall sheathing 6. Blanket-type insulation 3 with vapor barrier backing 43 is shown in the wall cavity 42. The insulation 3 comprises a plurality of mineral fibers 7. The insulation board 9, as it is utilized in FIG. 3 with the blanket-type insulation 3, may also be utilized in the present invention to further increase the "R" value of the wall, if desired.

FIG. 4 is a partial sectional side view of a wall illustrating an old method of placing loose-fill insulation 16 into a wall by use of interior openings 10 and 11. A wall section is shown in FIG. 4 extending from the building roof structure 14 to the building floor structure 12. Building floor structure 12 is underneath the structure being built and the ground 13 is exterior to the structure. The present use of loose-fill insulation 16 is to be placed into existing structures. Openings 10 and 11 are made in the building interior finish 8 through which loose-fill insulation 16 can be placed in order to fill the cavities in the wall. Because of the placement of wall purlins, such as wall purlins 15, an upper insulation insertion opening 10 and a lower insulation insertion opening 11 may be made in the building interior finish 8 in order to place the loose-fill insulation 16 into the finished wall.

FIG. 5 is a partial sectional side view of a wall illustrating an old method of placing loose-fill insulation 16 into a wall by use of exterior openings 17 and 18. In a structure which exists, loose-fill insulation 16 may also be placed into the wall through exterior openings, such as exterior openings 17 and 18. The exterior openings 17 and 18 would extend through the complete outer surface 29 of the structure. The outer surface 29 would include the building exterior finish 5, the wall sheathing 6, and the insulation board 9, if those layers are present, so that the openings would go into the interior wall. Loose-fill insulation 16 is then placed into the interior wall.

FIG. 6 is a partial plane view of a wall under construction illustrating a new method of placing loose-fill insulation 16 in the wall. The new method is a way to put loose-fill insulation 16 into the cavities of the wall without disturbing the normal building process. After the wall is erected with a plurality of wall studs 1, an upper building wall member 27, and a lower building wall member 28, the normal building process would be continued. Windows, such as window 31, would be placed into the wall. Doors, such as door 30, would be placed into the wall. The necessary electrical wiring, such as electrical wall box 32 and wiring 41, would be placed into the wall. Appropriate plumbing fixtures, such as plumbing connection 33 with associated vent piping 35 and waste piping 34, would be placed into the wall. A retainer barrier layer 19 would then be placed over the entire wall and secured thereto.

Areas where doors and windows exist will be cut from the retainer barrier layer 19 with the remaining retainer barrier layer 19 being secured around the doors or windows. Areas over electrical and plumbing connections will be opened with the retainer barrier layer 19 secured around the openings. The retainer barrier layer 19 may be any type of covering material that will retain loose-fill insulation 16 in the wall under pressure when it is placed or blown into the wall.

One material that might be utilized is shrink film. The use of shrink film as the retainer barrier layer 19 enables the retainer barrier layer 19 to act as a combination loose-fill retention device and as a moisture barrier. By using the material which can act as a moisture barrier, the retainer barrier layer 19 adds to the "R" value of the wall and serves the double purpose of retaining the loose-fill insulation 16 while serving as the moisture barrier. The retainer barrier layer 19 must consist of material which has the rigidity and strength to retain the loose-fill insulation 16 that is blown or placed into it. The retainer barrier layer 19 may be reinforced in some manner so that the material becomes rigid and will not bellow-out from the wall when filled with the loose-fill insulation 16. The retainer barrier layer 19 must be strong enough to retain the loose-fill insulation 16 without breaking open. The retainer barrier 19 might be any type of strong material which can perform the desired function of rigidly holding the loose-fill insulation 16 in place, when the loose-fill insulation 16 is blown or placed into the wall. By utilizing the shrink film as the retainer barrier layer 19, the shrink film performs the function of retaining the loose-fill insulation 16 in the cavities in the wall, operating as a moisture barrier, and, with the clear shrink film, the home owner or contractor will be able to actually see the loose-fill insulation 16 in the walls and will be able to judge appropriately the quality of the work performed by the insulator.

Insulation insertion slits 36 may be cut into the retainer barrier layer 19 for the purpose of installing the loose-fill insulation 16. Due to the wall purlins 15, upper and lowr insulation insertion slits 36 may be cut for use in inserting the loose-fill insulation 16. A plurality of insulation insertion slits 36 may be cut, one for each of the various cavities or cavity sections in the wall.

In FIG. 6, wall cavity 4 is shown uninsulated. The inner face 2 of wall sheathing 6 is seen in cavity 4. In wall cavity 44, plumbing connection 33, waste piping 34, and vent piping 35, are shown behind the retainer barrier layer 19. Insulation insertion slits 36 are cut into retainer barrier layer 19 in order to install the loose-fill insulation 16 above and below wall purlins 15. In wall cavity 42, retainer barrier layer 19 covers the wall cavity 42, with insulation insertion slits 36 cut into the retainer barrier layer 19. A patch 37 is shown which may cover the insulation insertion slits 36 after the loose-fill insulation 16 is installed, if desired.

In wall cavity 44, the retainer barrier layer 19 may be cut and secured around the plumbing connection 33. In wall cavity 42, the retainer barrier layer 19 may be cut and secured around the electrical wall box 32. If desired, for electrical units, such as electrical wall box 32 and plumbing connection 33, the retainer barrier layer 19 could be pressed against the units at the time the loose-fill insulation 16 is placed into the wall cavity.

The retainer barrier layer 19 may be secured to the plurality of wall studs 1, the upper building wall member 27, and the lower building wall member 28 by the use of attachment means 38. Attachment means 38 may be staples, tacks, or whatever attachment means is desired.

If shrink film is utilized as the retainer barrier layer 19, when the shrink film is heated, it becomes strong, tight and rigid and will properly perform the desired function of the retainer barrier layer 19.

FIG. 7 is a partial plane view of a wall under construction illustrating an alternative new method of placing loose-fill insulation 16 in the wall. FIG. 7 is shown utilizing a retainer barrier layer 19 which has horizontal reinforcement bands 39 and vertical reinforcement bands 40. This type of retainer barrier layer 19 may be utilized with electrical, plumbing, window, and door fixtures as shown in FIG. 6. FIG. 7 illustrates a type of retainer barrier layer 19 with added reinforcement for rigidity and strength purposes. The retainer barrier layer 19 must be strong enough to hold the loose-fill insulation 16 rigidly in place without breaking open or bellowing out so that an appropriate building interior finish 8 may be applied thereover with no bulges or misshaped portions caused by bulging insulation.

FIG. 8 is a partial sectional view of a wall illustrating how heat is applied to the retainer barrier layer 19 prior to the time that loose-fill insulation 16 is placed through the retainer barrier layer 19. When shrink film is utilized as the retainer barrier layer 19, heat is applied to the shrink film after it is secured to the wall structure. The heat causes the shrink film to tighten so that the surface becomes tight and flat. When the loose-fill insulation 16 is applied through the retainer barrier layer 19, the shrink film has the strength to maintain rigidity, while also performing the function of a moisture barrier. The heat is applied from a heat source 22 through a heat supply hose 21 to a heat supply nozzle 20, which can be moved by the insulator across the shrink film used as the retainer barrier layer 19 to tighten and flatten that surface before the application of the loose-fill insulation 16.

FIG. 9 is a partial sectional view of a wall illustrating how loose-fill insulation 16 is placed through retainer barrier layer 19. The loose-fill insulation 16 may be stored in any loose-fill material source 26 and placed through input means 25 into blowing means 24, which will propel the loose-fill insulation 16 through insulation injection hose 23.

Injection hose 23 is placed through insertion slit 36 into the wall cavity. When the wall cavity is filled with the loose-fill insulation 16, the injection hose 23 may be removed and placed into another one of the plurality of insertion slits 36 until the insulation task is complete.

This invention provides a method and apparatus for placing loose-fill insulation into wall cavities of new construction prior to the placement of the interior finish on the wall cavities without disturbing the normal building process. A retainer barrier layer 19 is secured to the wall cavities and is utilized to rigidly hold the loose-fill insulation 16 in the wall cavities without bulging or bellowing out. This insures that when the interior finish is put onto the wall cavities, it will be flat. The retainer barrier layer acts as a vapor barrier, as well as being a retainer for holding the loose-fill insulation 16. The retainer barrier layer may be clear so that the prospective home purchaser or insulator can observe the amount of insulation being placed into the wall cavities. Utilizing this new, easy method of insulating a new home, a high "R" value for the home can be achieved, thus saving energy.

Shrink film may be utilized as the retainer barrier layer 19. The shrink film has the molecular structural characteristic that after exposure to heat, as it cools, it shrinks and gets tight. The shrink film not only gets tight, but assumes a more rigid state than prior to being shrunk. The shrink film may be clear which enables an examination or evaluation of the insulation process to be easily done by sight. The shrink film may be easily cut with a knife to provide an entrance for the loose-fill insulation 16 to be placed into the wall cavity. The shrink film also forms a moisture barrier.

Other materials may be utilized as the retainer barrier layer 19 which become more rigid with application of a cold temperature or different combinations of temperature differentials.

This invention covers any type of covering material that will retain the insulation in the wall under pressure when it is blown or placed therein without bulging or breaking. Any type of securing means to secure the retainer barrier layer 19 onto the structural component may be utilized. Any type of heating means may be utilized to heat the shrink film. Any type of removal means may be utilized to remove the retainer barrier layer 19 from around windows, doors, and electrical and plumbing components, if desired. Any type of filling means may be utilized to place the loose-fill insulation 16 through the plurality of small entrances into the structure cavity. Any type of patching means may be utilized to patch the plurality of small entrances or openings, if desired. Any type of reinforcing means may be utilized to reinforce the material used as a retainer barrier layer 19. Any type of means available can be utilized to perform the function of any means discussed in this patent application.

The shrink film utilized in the present invention may be a polyethelene film. The thickness of the film may be four or five mils thick, or any other desired thickness. The polyethelene film is an extruded polyethelene of low or medium density with the capability of shrinking after heat has been applied. This film is commonly referred to as "shrinkable polyethelene" or "shrink poly".

The insulation board discussed herein may consist of any of a number of materials such as Thermax Sheathing manufactured by the Celotex Corporation, Fome Cor underlayment board manufactured by Monsanto; or other products manufactured by other various corporations.

The loose-fill insulation may be of any type including cellulose, fiberglass, rockwool, vermiculite, and ceramic-coated vermiculite.

The retainer barrier layer 19 may be placed over the entire wall as previously discussed. The retainer barrier layer 19 may be secured around and later removed from plumbing and electrical interior fixtures, doors, and windows. The retainer barrier layer 19 can also be applied over any home entertainment modules, such as speakers and stereo equipment which may be secured into the walls. After the insulation is placed into the walls, the retainer barrier layer 19 over the home entertainment modules would be rmoved with no damage having been incurred to the home entertainment modules.

In a situation where a wall between an uninsulated room, such as a garage, and an insulated room needs to be insulated, the present invention can still be utilized. In that case, the retainer barrier layer 19 can be placed on both sides of the wall with the rigid retainer barrier layer 19 holding the loose-fill insulation 16 in place until the appropriate outer wall layer is applied to the interior wall and to the exterior wall, if desired.

The present invention solves a problem within the loose-fill insulation industry which enables loose-fill insulation to be utilized in new construction or construction where the interior finish of the structural component has been removed. These are uses for loose-fill insulation which have not been available up to this time. This invention enables the loose-fill insulation industry to compete with the blanket-type insulation industry that is predominate in new construction at this time.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A method of placing loose-fill insulation in a structural component containing structure cavities prior to the placement of the interior finish onto said structural component comprising:

a. covering said structural component with a retainer barrier layer comprising shrink film;

b. opening a plurality of small entrances in said retainer barrier layer, each of said plurality of small entrances opening into one of said structure cavities, said plurality of small entrances being of sufficient number so that each of said structure cavities has one of said plurality of small entrances;

c. placing said loose-fill insulation through said plurality of small entrances into said structure cavities; and d. heating said shrink film by use of heating means prior to placing said loose-fill insulation through said plurality of small entrances into said structure cavities.

2. A method according to claim 1 further comprising heating said shrink film by use of heating means prior to opening said plurality of small entrances of said retainer barrier layer covering said structure cavities.

3. A method according to claim 1 further comprising placing the electrical components in said structure cavities prior to covering said structure cavities with said retainer barrier layer.

4. A method according to claim 1 further comprising placing plumbing components in said structure cavities prior to covering said structure cavities with said retainer barrier layer.

5. A method according to claim 3 further comprising placing plumbing components in said structure cavities prior to covering said structure cavities with said retainer barrier layer.

6. A method according to claim 5 further comprising heating said shrink film by use of heating means prior to opening said plurality of small entrances of said retainer barrier layer covering said structure cavities.

7. A method according to claim 1 further comprising securing said retainer barrier layer around window and door units in said structural component and removing said retainer barrier layer which has been placed over said window and door units.

8. A method according to claim 1 further comprising patching said plurality of small entrances in said retainer barrier layer after placing said loose-fill insulation through said plurality of small entrances into said structure cavities.

9. A method according to claim 1 further comprising reinforcing said retainer barrier layer to maintain better rigidity and strength in the material being utilized for said retainer barrier layer.

10. A method according to claim 1 further comprising securing said retainer barrier layer to said structural component after said structural component has been covered with said retainer barrier layer.

11. A method according to claim 3 further comprising securing said retainer barrier layer around the interior connections of said electrical components and then removing said retainer barrier layer covering said interior connections of said electrical components.

12. A method according to claim 6 further comprising securing said retainer barrier layer around the interior connections of said plumbing components and then removing said retainer barrier layer covering said interior connections of said plumbing components.

13. A method according to claim 1 further comprising placing window and door units into said structural component prior to covering said structural component with said retainer barrier layer.

14. A method according to claim 1 further comprising:

a. placing window and door units into said structural component prior to covering said structural component with said retainer barrier layer;

b. placing the electrical components in said structure cavities prior to covering said structure cavities with said retainer barrier layer;

c. placing the plumbing components in said structure cavities prior to covering said structure cavities with said retainer barrier layer; and d. securing said retainer barrier layer to said structural component after said structural component has been covered with said retainer barrier layer.

15. A method according to claim 14 further comprising securing said retainer barrier layer around window and door units in said structural component and removing said retainer barrier layer which has been placed over said window and door units.

16. A method according to claim 15 further comprising:

a. securing said retainer barrier layer around the interior connections of said electrical components and then removing said retainer barrier layer covering said interior connections of said electrical components; and b. securing said retainer barrier layer around the interior connections of said plumbing components and then removing said retainer barrier layer covering said interior connections of said plumbing components.

* * * * *